US005774024A

United States Patent [19]

Marusawa et al.

[11] Patent Number: 5,774,024

[45] Date of Patent: Jun. 30, 1998

[54] MICROWAVE NON-RECIPROCAL CIRCUIT ELEMENT

[75] Inventors: Hiroshi Marusawa; Takehiro Konoike; Kunisaburo Tomono; Takashi Kawanami; Takashi Hasegawa, all of Nagaokakyo, Japan

[73] Assignee: Murata Manufacturing Co, Ltd., Nagaokakyo, Japan

[21] Appl. No.: 755,148

[22] Filed: Sep. 25, 1996

Related U.S. Application Data

[63] Continuation of Ser. No. 500,888, filed as PCT/JP94/01623, Sep. 29, 1994 published as WO95/30252, Nov. 9, 1995, abandoned.

[30] Foreign Application Priority Data

Apr. 2, 1993 [JP] Japan ..... 5-076977
Apr. 28, 1994 [JP] Japan ..... 6-091011

[51] Int. Cl.[6] ..... H01P 1/383

[52] U.S. Cl. ..... 333/1.1; 333/238

[58] Field of Search ..... 333/1.1, 238, 246

[56] References Cited

U.S. PATENT DOCUMENTS 3,614,675 10/1971 Konishi ..... 333/1.1 X
5,153,537 10/1992 Desmarest ..... 333/1.1
5,450,045 9/1995 Miura et al. ..... 333/1.1

FOREIGN PATENT DOCUMENTS 0 446 107 A1 9/1991 European Pat. Off. .
57-26912 2/1982 Japan .
57-61314 4/1982 Japan .
4-345201 12/1992 Japan .
5-299904 11/1993 Japan .
5-304404 11/1993 Japan .
6-291514 10/1994 Japan .

*Primary Examiner*—Paul Gensler
*Attorney, Agent, or Firm*—Burns, Doane, Swecker & Mathis, LLP

[57] ABSTRACT

A microwave non-reciprocal circuit element which is further miniaturized and of low losses without causing conductor losses in center electrodes following miniaturization. The microwave non-reciprocal circuit element according to the present invention comprises a plurality of center electrodes which are arranged to intersect with each other in a state electrically insulated from each other, and a microwave magnetic or dielectric body which is arranged on an intersecting portion of the plurality of center electrodes, and the respective center electrodes are formed by a plurality of conductors 55, 56 and 57 which are stacked through the microwave magnetic or dielectric body.

8 Claims, 21 Drawing Sheets

MICROWAVE NON-RECIPROCAL CIRCUIT ELEMENT

This application is a continuation of application Ser. No. 08/500,888, filed as PCT/JP94/01623, Sep. 29, 1994, published as WO95/30252, Nov. 9, 1995, now abandoned.

TECHNICAL FIELD

The present invention relates to a non-reciprocal circuit element which is employed in the microwave band, and relates to a microwave non-reciprocal circuit element which is employed for a circulator or an isolator, for example.

BACKGROUND TECHNIQUE

In recent years, progress in miniaturization and generalization of a high-frequency devices in mobile communications or the like, and progress in miniaturization and cost reduction in a non-reciprocal circuit element employed therefor are strongly required.

As an example of the aforementioned non-reciprocal circuit element, there is an element having a structure including a plurality of center electrodes which are arranged to intersect each other in an electrically insulated state and microwave magnetic bodies which are arranged on upper and lower portions of the plurality of center electrodes so that a dc magnetic field is applied by permanent magnets to a portion where the aforementioned plurality of center electrodes intersect each other. This is the so-called lumped element type nonreciprocal circuit element, such as a lumped element type circulator or isolator, for example.

FIG. 1 is an exploded perspective view illustrating a first example of a conventional microwave non-reciprocal circuit element. This microwave non-reciprocal circuit element has a structure formed by stacking rectangular dielectric substrates 1 to 3. Ports 1*a* to 1*f*, 2*a* to 2*f* and 3*a* to 3*f* are formed on upper surfaces of the respective dielectric substrates 1 to 3 respectively. The respective ports 1*a* to 3*f* are structured by forming conductive films to be electrically connected to through hole electrodes which are arranged to enclose centers of the respective dielectric substrates 1 to 3 respectively.

In the dielectric substrate 1, a center electrode 4 is formed to connect the port 1*a* with the port id. Similarly, center electrodes 5 and 6 are formed also on the upper surfaces of the dielectric substrates 2 and 3. The center electrodes 4 to 6 are structured to extend in different directions when the dielectric substrates 1 to 3 are stacked, i.e., to intersect in overlapping planes, but electrically insulated from each other through the dielectric substrates.

The aforementioned microwave non-reciprocal circuit element is structured by stacking the dielectric substrates 1 to 3 in the illustrated embodiment.

FIG. 2 is an exploded perspective view for illustrating a second example of a conventional microwave non-reciprocal circuit element.

In the microwave non-reciprocal circuit element of the second example, ports 7*a* to 7*f* . . . 9*a* to 9*f* are formed on upper surfaces of dielectric substrate 7 to 9, similar to the first example of FIG. 1, and center electrodes 10 to 12 are similarly formed. However, the center electrodes 10 to 12 are longitudinally extending pairs of conductors 10*a* and 10*b* to 12*a* and 12*b* coupled with each other on both ends respectively, as shown in FIG. 2. As to other structures, this element is structured similar to the microwave non-reciprocal circuit element shown in FIG. 1.

FIG. 3 is an exploded perspective view for illustrating a third example of a conventional microwave non-reciprocal circuit element. In the microwave non-reciprocal circuit element of the third example, a center electrode 14*a* consisting of metal foil, such as Cu foil, for example, is arranged on a discoidal microwave magnetic body 13*a*.

The center electrode 14*a* is so shaped as to pass through a center of an upper surface of the microwave magnetic body 13*a*, extend in the diametral direction, and further reach side surfaces of the microwave magnetic body 13*a*. Then, an insulating film 15*a* consisting of an insulating material is arranged on the aforementioned center electrode 14*a*, and another center electrode 14*b* is arranged thereon to intersect with the center electrode 14*a*. Further, an insulating film 15*b*, a center electrode 14*c* and an insulating film 15*c* are successively arranged on the aforementioned center electrode 14*b*, and a microwave magnetic body 13*b* is stacked and fixed. Thereafter permanent magnets are arranged on upper and lower portions so that a dc magnetic field is applied to the structural body which is held by the microwave magnetic bodies 13*a* and 13*b*.

In a microwave non-reciprocal circuit element, widths of center electrodes are preferably broad since conductor losses are reduced as the widths of the center electrodes are increased. Following miniaturization of the nonreciprocal circuit element, however, the widths of the center electrodes must also be inevitably narrowed. In the conventional microwave non-reciprocal circuit elements described with reference to FIGS. 1 to 3, therefore, widths of the center electrodes 4 to 6, 10 to 12 and 14*a* to 14*c* must be narrowed when further miniaturization is promoted, and hence there have been such problems that conductor losses are increased and the amounts of attenuation in transmission directions are increased.

In a method of manufacturing the microwave nonreciprocal circuit element described with reference to FIG. 3, on the other hand, the respective center electrodes 14*a* to 14*c* consisting of metal foil have been assembled by manually stacking the same alternately with the insulating films 15*a* to 15*c*. Due to miniaturization of the microwave non-reciprocal circuit element, however, the lengths of the aforementioned center electrodes 14*a* to 14*c* are now being reduced to about several mm, and manual assembly is now being extremely difficult. Consequently, imperfect assembly such as relative misregistration between the center electrodes 14*a* to 14*c* is caused when a miniature microwave non-reciprocal circuit element is fabricated, and it has been difficult to obtain a microwave non-reciprocal circuit element which is excellent in reliability.

Since the element has been manually assembled as described above, further, there has also been such a problem that imperfect assembly is frequently caused to increase the manufacturing cost.

In addition, a relatively large number of components are required as hereinabove described, while limitation is now being caused in cost reduction of the individual components, and cost reduction for the microwave nonreciprocal circuit element is now being made difficult.

Objects and Summary of the Invention

An object of the present invention is to provide a microwave non-reciprocal circuit element which is further miniaturized and brought into a low loss state, without causing conductor losses in center electrodes following miniaturization.

According to a broad aspect of the present invention, a microwave non-reciprocal circuit element is provided comprising a plurality of center electrodes which are arranged to intersect each other in overlapping plans but electrically insulated from each other, and a microwave magnetic or dielectric body which is arranged on an intersecting portion of the said plurality of center electrodes, and each of the said center electrodes includes a plurality of conductors stacked through the microwave magnetic or dielectric body.

According to the present invention, each of the plurality of center electrodes which are made to intersect with each other in the microwave non-reciprocal circuit element in the state electrically insulated from each other is structured by a plurality of conductors which are stacked through the microwave magnetic or dielectric body. Therefore, conductor losses in the center electrodes can be reduced by increasing the number of the conductors since each center electrode is structured by the aforementioned plurality of conductors. Also when miniaturization of the microwave non-reciprocal circuit element is attempted, therefore, reduction of conductor losses can be prevented by simply increasing the number of stacking, whereby it is possible to provide a microwave non-reciprocal circuit element which is further miniaturized and of low losses as compared with the conventional microwave non-reciprocal circuit elements.

In a certain specific aspect of the present invention, the plurality of conductors structuring the said each center electrode may be embedded in the microwave magnetic or dielectric body so that the respective center electrodes are successively arranged in the direction of thickness in the microwave magnetic or dielectric body, as to the plurality of conductors structuring the aforementioned center electrodes. Alternatively, the plurality of conductors structured by the said each center electrode may be embedded in the microwave magnetic or dielectric body so that the conductors structuring one center electrode and the plurality of conductors structuring the remaining center electrodes are stacked at random in the microwave magnetic or dielectric body in the direction of thickness.

In the aforementioned specific aspect of the present invention, the aforementioned center electrodes are embedded in the microwave magnetic or dielectric body, further successively stacked in the microwave magnetic or dielectric body in the direction of thickness, or the plurality of conductors structuring the aforementioned center electrodes are stacked at random in the microwave magnetic or dielectric body in the direction of thickness. In either of the aforementioned cases, the plurality of conductors structuring the center electrodes are embedded in the microwave magnetic or dielectric body, whereby not only miniaturization and loss reduction can be attained but environment resistance of the microwave non-reciprocal circuit element can be improved by structuring one center electrode by a plurality of conductors.

According to another specific aspect of the present invention, the microwave non-reciprocal circuit element has first to third center electrode portions which consist of the said plurality of conductors and are successively arranged in the direction of thickness, and at least one conductor structuring the said first center electrode portion is arranged on an outer side of the third center electrode portion in the direction of thickness while at least one conductor structuring the third center electrode portion is arranged on an outer side of the first center electrode portion in the direction of thickness. The distance between at least one conductor which is arranged on the outer side of the said third center electrode portion and the conductor of the third center electrode portion which is adjacent to the conductor in the direction of thickness, and the distance between at least one conductor which is arranged on the outer side of the said first center electrode portion and the first center electrode portion which is adjacent to the conductor in the direction of thickness are rendered larger than the distances between other adjacent conductors.

In the structure of arranging at least single conductors which are positioned on the outer sides in the direction of thickness among the plurality of conductors structuring the first and third center electrode portions on opposite sides, i.e., the outer side of the third or first center electrode portion in the direction of thickness, as hereinabove described, it is possible to compensate for shortage of distributed capacitances by the conductors arranged in the aforementioned manner and the conductor of the third or first center electrode portion which is adjacent to the said conductors. Thus, it is possible to increase the distributed capacitances across the first and third center electrode portions, and to make the distributed capacitance across the first and third center electrode portions equal to the distributed capacitance across the first center electrode portion and the second center electrode portion and the distributed capacitance across the second center electrode portion and the third electrode portion. Consequently, I.L. characteristics, isolation identification and return loss characteristics can be uniformalized, and it is possible to cope with improvement in performance of the non-reciprocal circuit element. Further, it is possible to take matched capacitances by the distributed capacitances across the respective center electrode portions. Thus, it is possible to omit a circuit element for matching which has been separately added in general and to cope with miniaturization and weight reduction of the non-reciprocal circuit element, while it is also possible to attain reduction of the cost for the nonreciprocal circuit element.

Further, the conductors structuring the respective center electrode portions are brought into multilayer structures, whereby resistances of the center electrodes can be reduced, thereby improving the Q values. Thus, the Q values can be increased, thereby reducing insertion losses.

According to the present invention, as hereinabove described, it is possible to remarkably contribute to miniaturization, generalization and improvement in performance of a high-frequency device such as a mobile communication device.

BEST MODE FOR CARRYING OUT THE INVENTION

Embodiments of the microwave non-reciprocal circuit element according to the present invention are now described, to clarify the details of the present invention.

First Embodiment

Figure 1:
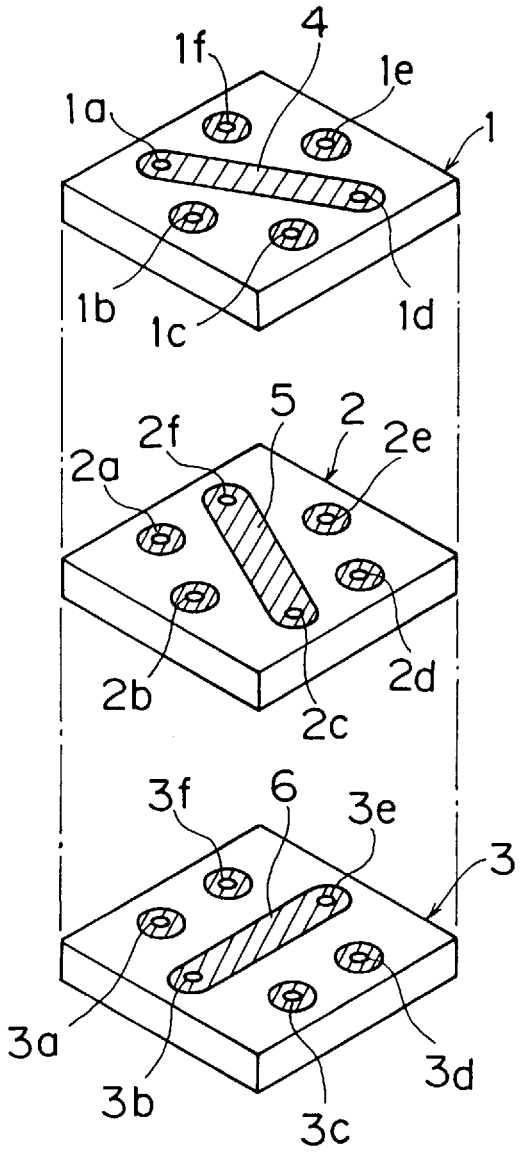
FIG. 1 is an exploded perspective view for illustrating a first example of a conventional microwave non-reciprocal circuit element.
Figure 2:
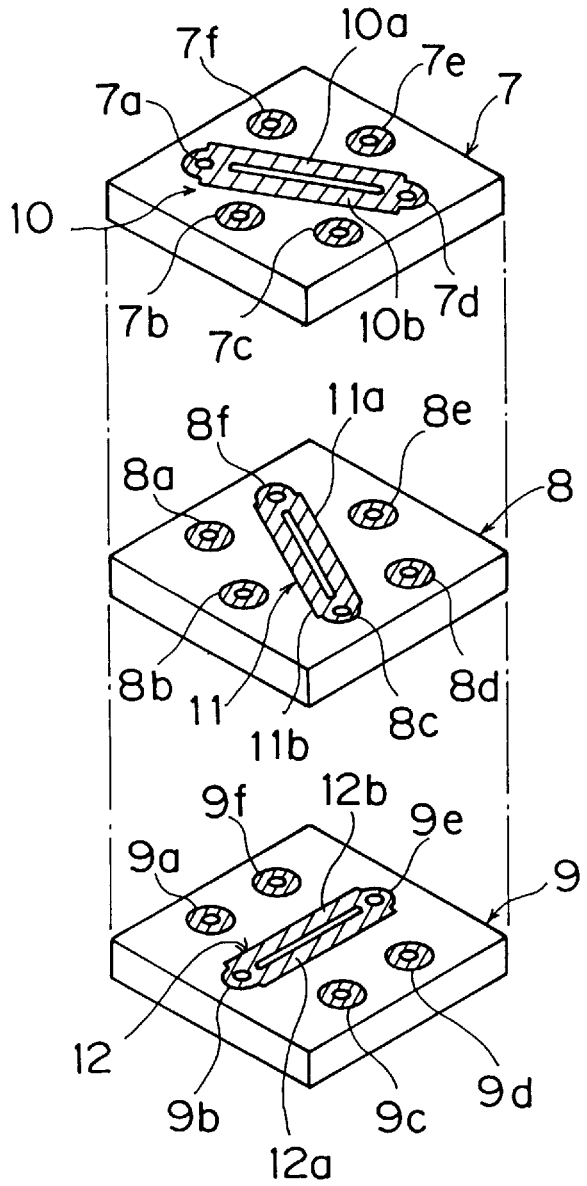
FIG. 2 is an exploded perspective view for illustrating a second example of a conventional microwave non-reciprocal circuit element.
Figure 3:
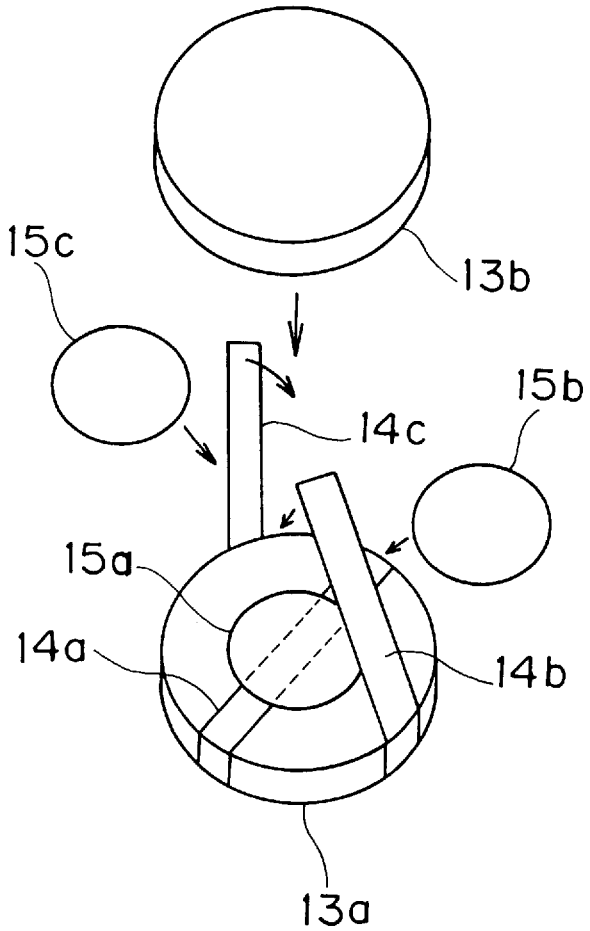
FIG. 3 is an exploded perspective view for illustrating a third example of a conventional microwave non-reciprocal circuit element.
Figure 4:
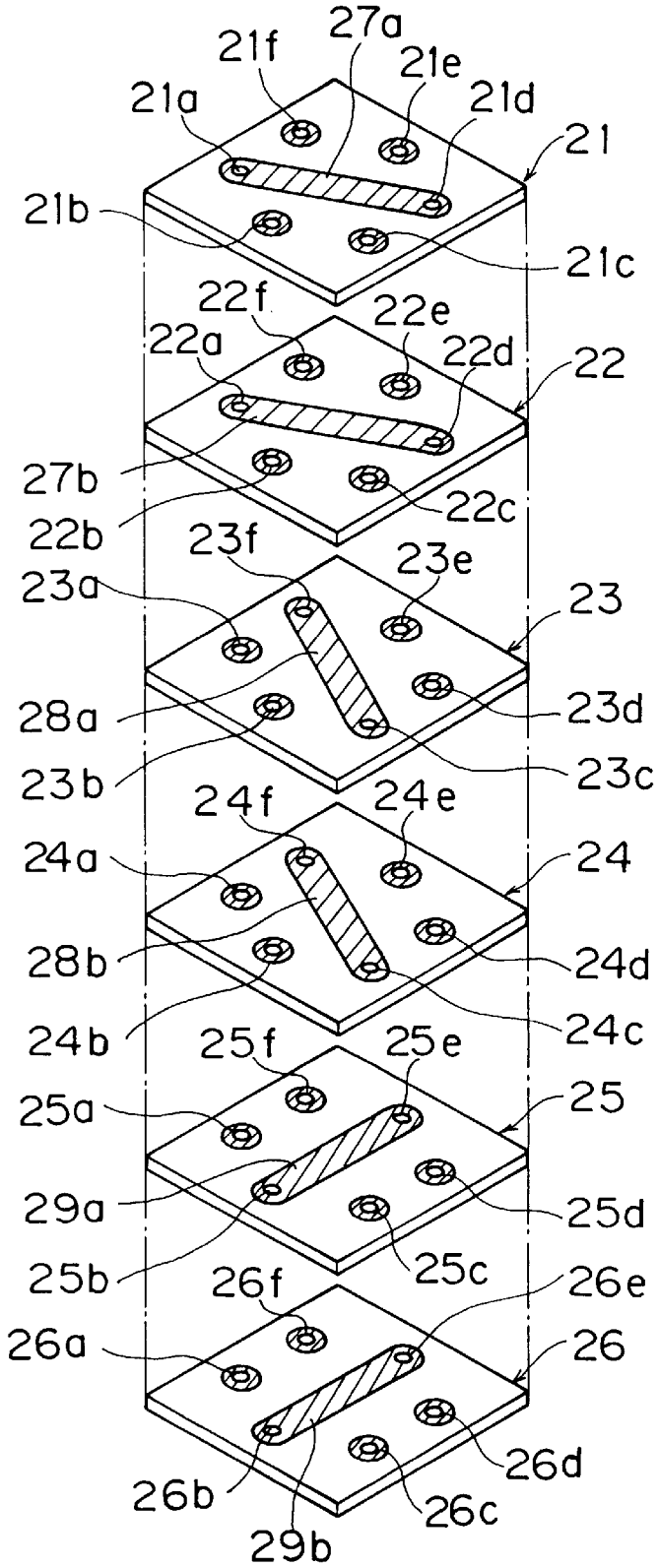
FIG. 4 is an exploded perspective view for illustrating a first embodiment.

FIG. 4 is an exploded perspective view for illustrating a microwave non-reciprocal circuit element according to a first embodiment of the present invention. The microwave non-reciprocal circuit element according to the first embodiment is structured by stacking a plurality of rectangular dielectric substrate 21 to 26, and fixing the same to each other by adhesives or the like. As to the dielectric substrates 21 to 26, those consisting of an arbitrary dielectric material such as barium titanate dielectric ceramics, for example, can be employed.

On upper surfaces of the dielectric substrates 21 to 26, hexadic ports 21*a* to 21*f* . . . 26*a* to 26*f* which are arranged around centers of the upper surfaces to be connected to through hole electrodes are formed respectively. With reference to the dielectric substrate 21, for example, a conductor 27*a* structuring a center electrode is formed on its upper surface to connect the ports 21*a* and 21*d* with each other among the aforementioned ports. Similarly, a conductor 27*b* is formed also on the upper surface of the dielectric substrate 22, to connect the port 22*a* with the port 22*d*. The conductors 27*a* and 27*b* can be formed by applying conductive paste and baking the same, or by a proper conductive film forming method, respectively.

According to this embodiment, the aforementioned conductors 27*a* and 27*b* are electrically connected with each other on both ends via through hole electrodes, thereby forming one center electrode.

Similarly, conductors 28*a* and 28*b* which are formed on the upper surfaces of the dielectric substrates 23 and 24 form one center electrode, and conductors 29*a* and 29*b* which are formed on the upper surfaces of the dielectric substrates 25 and 26 form another center electrode.

In the microwave non-reciprocal circuit element according to this embodiment, the respective center electrodes are formed by the plurality of conductors 27*a* and 27*b* to 29*a* and 29*b* which are stacked along the direction of thickness, as described above. Also when the widths of the respective conductors 27*a* to 29*b* are narrowed following miniaturization of the microwave non-reciprocal circuit element, therefore, conductor losses can be reduced since one center electrode is formed by a plurality of stacked conductors. Thus, it is possible to obtain a microwave nonreciprocal circuit element which is of low losses and miniature.

Figure 5:
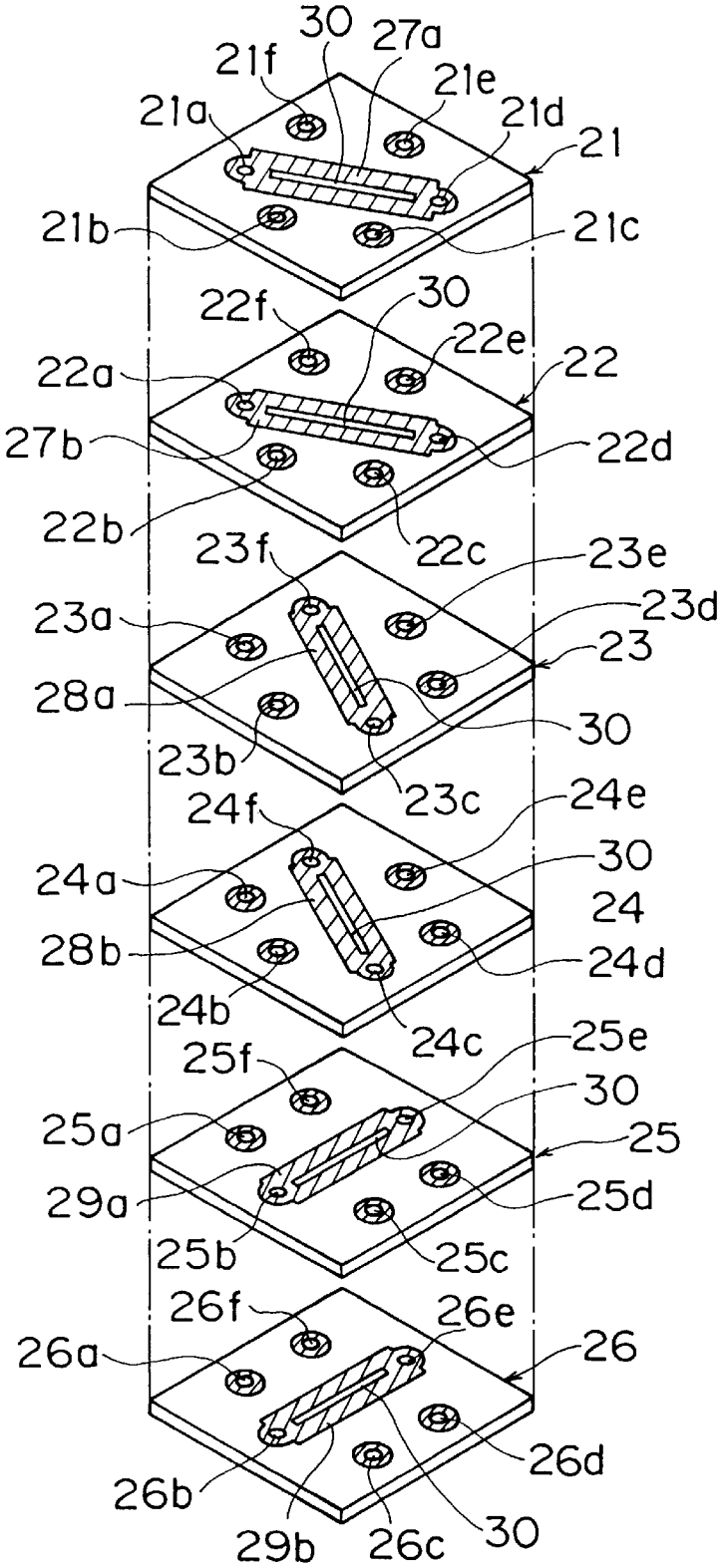
FIG. 5 is an exploded perspective view showing a modification of a microwave non-reciprocal circuit element according to the first embodiment.
Figure 6:
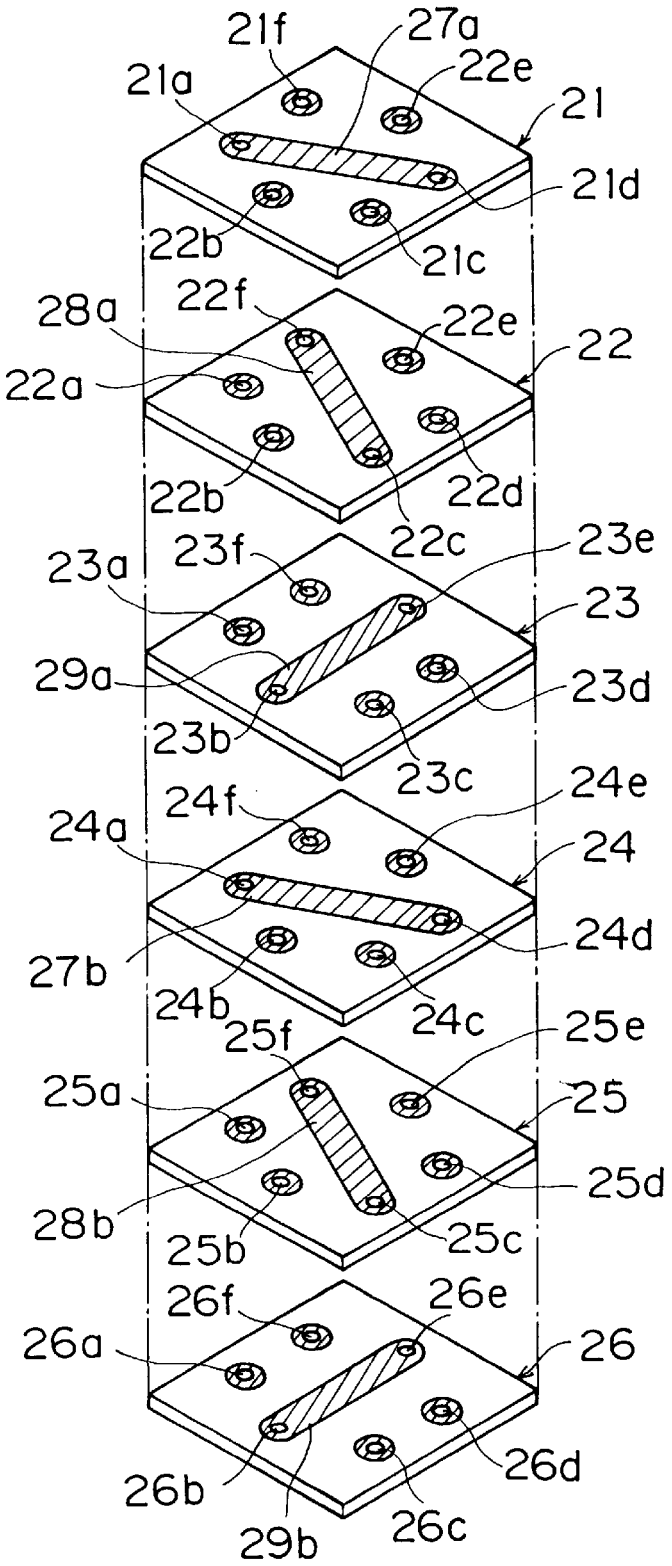
FIG. 6 is an exploded perspective view showing a second modification of the microwave non-reciprocal circuit element according to the first embodiment.
Figure 7:
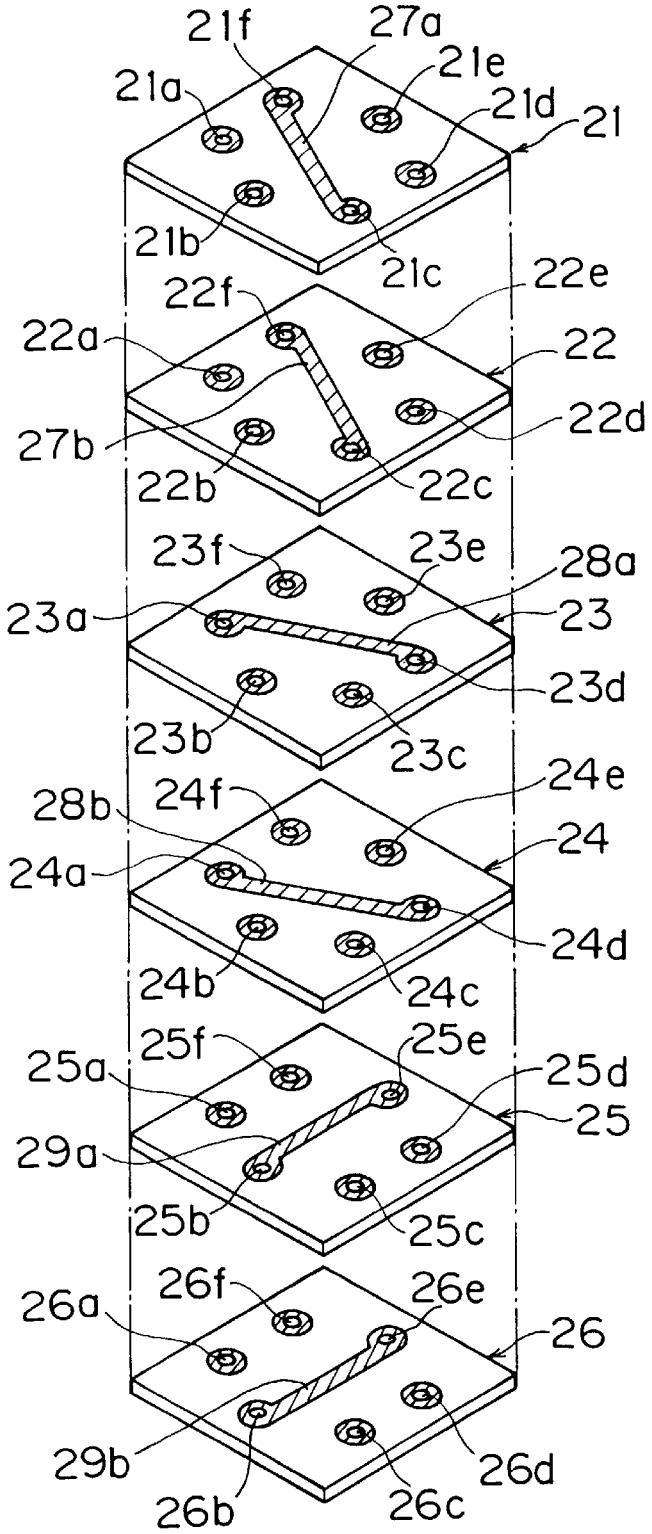
FIG. 7 is an exploded perspective view showing a third modification of a microwave non-reciprocal circuit element according to a second embodiment.

FIGS. 5 to 7 are respective exploded perspective views showing modifications of the microwave non-reciprocal circuit element according to the first embodiment. These modifications are similar to the first embodiment except that center electrode portions are changed, and hence similar portions are denoted by similar reference numerals, to omit description thereof.

In the modification shown in FIG. 5, conductors 27*a* to 29*b* are structured to have pairs of electrode portions which are formed to extend through slits 30, as shown in the figure. Thus, it is possible to attain further reduction of conductor losses.

In the modification shown in FIG. 6, on the other hand, conductors 27*a* and 27*b* structuring a first center electrode are formed on dielectric substrates 21 and 24. Similarly, conductors 28*a* and 28*b* structuring a second center electrode are formed on dielectric substrates 22 and 25. Further, conductors 29*a* and 29*b* structuring a third center electrode are formed on dielectric substrates 23 and 26. Thus, the conductors structuring the respective center electrodes may be arranged at random in the direction of thickness in the finally stacked state.

In the modification shown in FIG. 7, respective conductors 27*a* to 29*b* are formed on single sides of virtual straight lines connecting centers of pairs of ports which are coupled by the conductors. Representatively describing the conductors 27*a* and 27*b*, for example, the conductor 27*a* is formed on one side of the aforementioned virtual straight line, while the conductor 27*b* is formed on the other side of the aforementioned virtual straight line. Therefore, the conductors 27*a* and 27*b* are arranged not to overlap with each other in the direction of thickness in a stacked state. The conductors stacked on the remaining center electrodes are also arranged not to overlap with each other in the direction of thickness similarly.

Second Embodiment

Figure 8:
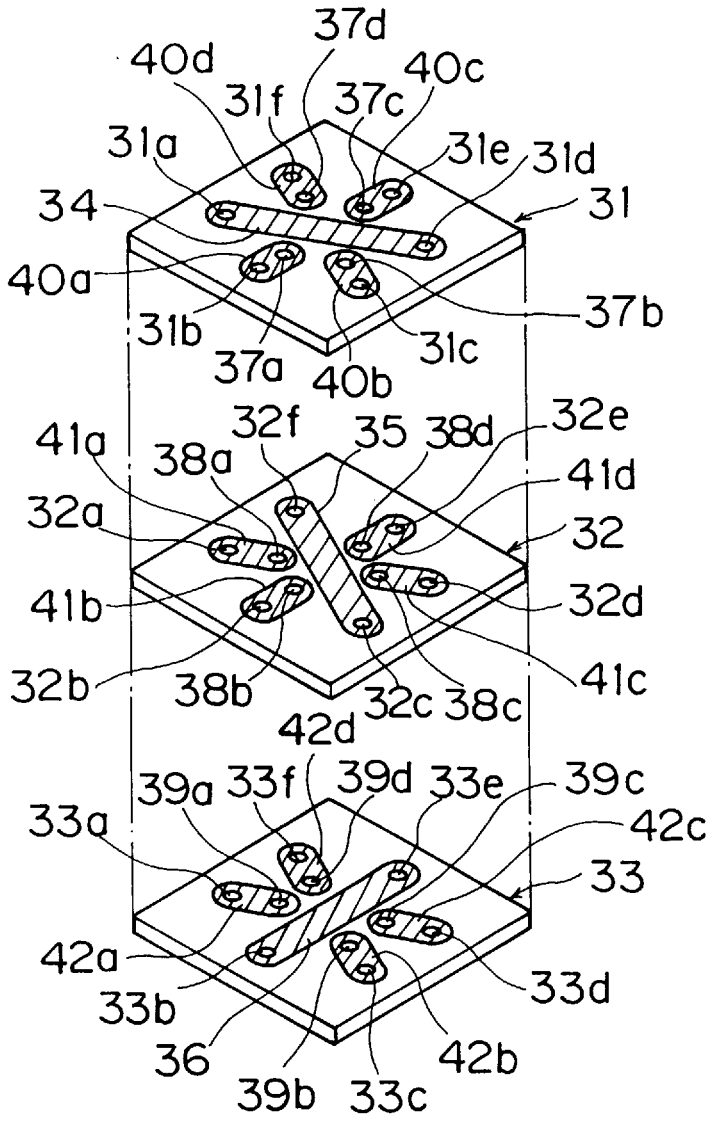
FIG. 8 is an exploded perspective view for illustrating a microwave non-reciprocal circuit element according to the second embodiment.

FIG. 8 is an exploded perspective view for illustrating a microwave non-reciprocal circuit element according to a second embodiment of the present invention. In the microwave non-reciprocal circuit element according to this embodiment, dielectric substrates 31 to 33 are stacked. As to these dielectric substrates 31 to 33, those consisting of a material which is similar to the first embodiment can be employed.

On upper surfaces of the dielectric substrates 31 to 33, hexadic ports 31*a* to 31*f* . . . 33*a* to 33*f* which are arranged around centers at regular intervals are formed by applying conductive films to be electrically connected to through hole electrodes respectively. Further, a conductor 34 is formed to connect the ports 31*a* and 31*d* with each other, while a conductor 35 is formed to connect the ports 32*c* and 32*f* with each other and a conductor 36 is formed to connect the ports 33*b* and 33*e* with each other similarly.

As to the remaining ports, on the other hand, conductors 40*a* to 40*d*, 41*a* to 41*d* and 42*a* to 42*d* are formed to be electrically connected to the respective ports and through hole electrodes 37*a* to 37*d*, 38*a* to 38*d* and 39*a* to 39*d* which are formed on positions close to center sides of the upper surfaces of the dielectric substrates 31 and 33 respectively.

The aforementioned conductors 40*a* to 42*d* are formed to partially overlap with any of the conductors 34 to 36 which are stacked with each other through the dielectric substrates 31 to 33, respectively. Further, the same are electrically connected to center electrodes which are stacked to overlap with each other by the through hole electrodes.

For example, the conductors 40*b* and 40*d* are formed to extend in the same direction as the conductor 35 on the dielectric substrate 32, while the conductors 42*b* and 42*d* are also formed to extend in the same direction as the conductor 35 similarly. Further, these conductors 40*b*, 40*d*, 42*b* and 42*d* are electrically connected with the conductor 35. In the stacked state, therefore, not only the aforementioned conductor 35 but the aforementioned conductors 40*b*, 40*d*, 42*b* and 42*d* are connected between a pair of ports, whereby one center electrode is structured by a plurality of stacked conductors, similarly to the first embodiment. Thus, conductor losses can be reduced also when miniaturization so progresses that the widths of the respective conductors must inevitably be narrowed similarly to the first embodiment, whereby it is possible to obtain a microwave non-reciprocal circuit element which is of low losses and miniature.

As obvious from the second embodiment, the plurality of conductors for structuring the center electrodes in the present invention may simply extend in the same directions so far as the same are conductors which are arranged to connect pairs of ports with each other, and it is not necessary that all of the respective conductors directly electrically connect pairs of ports with each other.

Third Embodiment

As a third embodiment, the following concrete experimental example is described.

Magnetic powder mainly composed of yttrium oxide ($Y_2O_3$) and iron oxide ($Fe_2O_3$) was dispersed in an organic solvent with a polyvinyl alcohol binder, to prepare a magnetic slurry. The prepared magnetic slurry was employed to mold a magnetic green sheet having a uniform thickness of several 10 $\mu$m by a doctor blade coater, and the sheet was punched to have a rectangular shape of 40 mm×20 mm.

Figure 9:
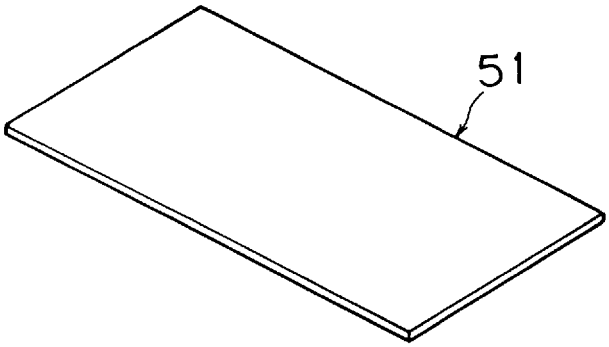
FIG. 9 is a perspective view showing a magnetic green sheet employed in a third embodiment.
Figure 10:
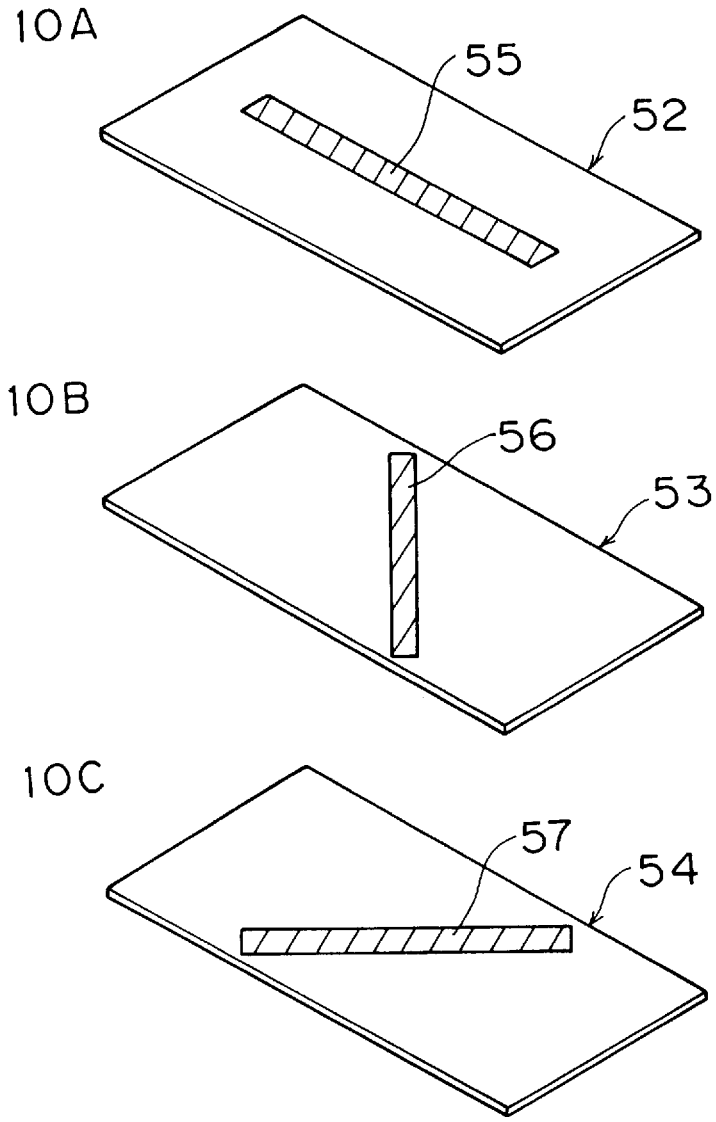
FIGS. 10A, 10B, 10C are respective perspective views showing magnetic green sheets and conductors printed on the sheets in the third embodiment.

A magnetic green sheet 51 having a rectangular plane shape shown in FIG. 9 was prepared in the aforementioned manner. Conductor paste prepared by mixing palladium powder and platinum powder with an organic solvent was printed on an upper surface of the aforementioned magnetic green sheet 51 by screen printing, to prepare magnetic green sheets 52 to 54 shown in FIGS. 10(a) to (c). On the magnetic green sheets 52 to 54, conductors 55 to 57 of elongated rectangular shapes are formed by printing conductive paste in the aforementioned manner respectively. These conductors 55 to 46 are formed to deviate from each other by about 120° about centers of the respective green sheets 52 to 54.

Figure 11:
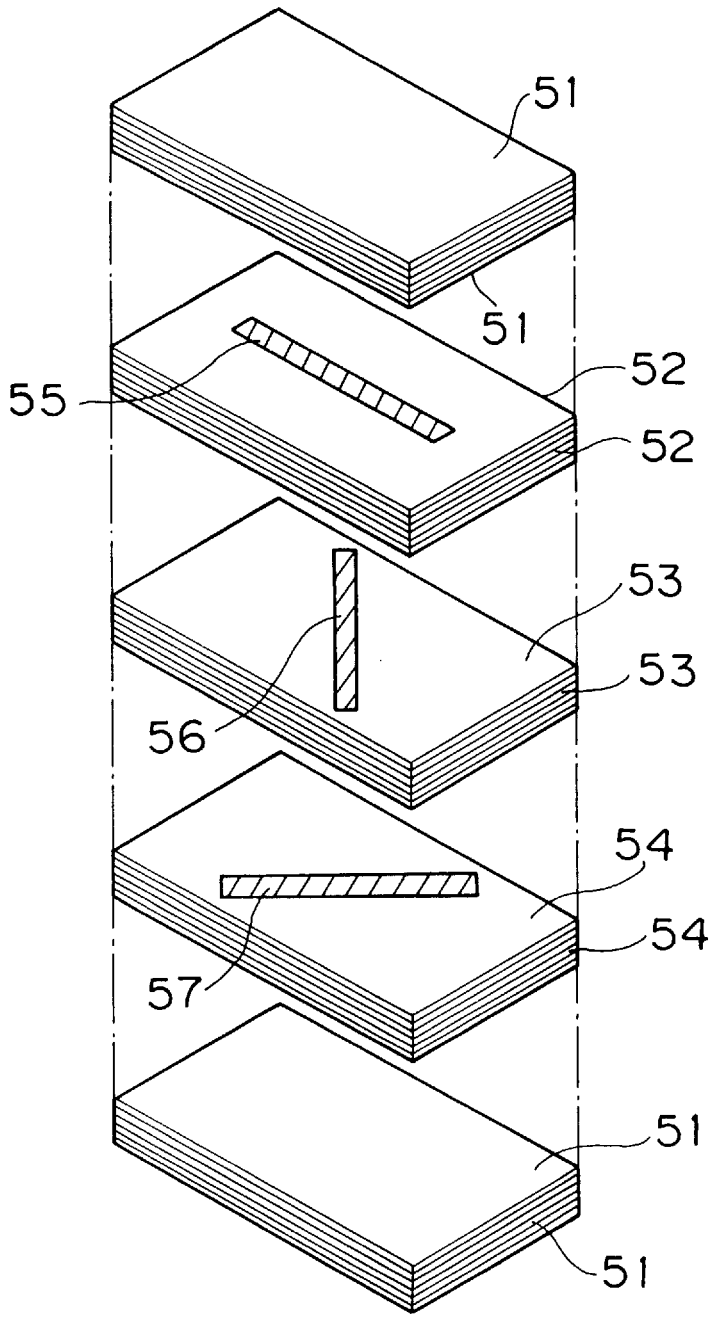
FIG. 11 is an exploded perspective view for illustrating magnetic green sheets stacked in the third embodiment.
Figure 12:
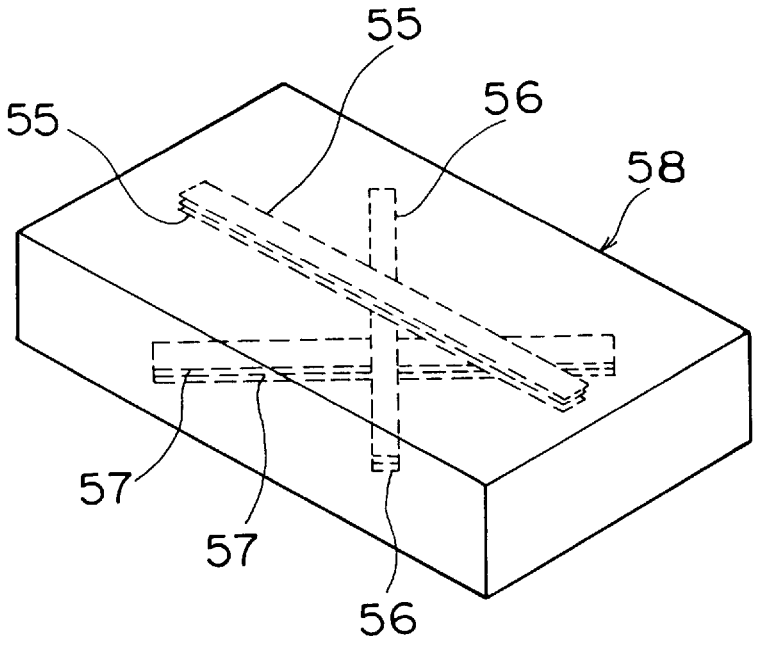
FIG. 12 is a perspective view showing a laminate prepared in the third embodiment.

Then, as shown in FIG. 11, a laminate was obtained by stacking a plurality of magnetic green sheets 52 prepared in the aforementioned manner, also stacking plural magnetic green sheets 53 and 54 similarly, further stacking these, stacking a plurality of blank magnetic green sheets 51 having no conductors printed on upper and lower portions, and compression-bonding theses green sheets in the direction of thickness. FIG. 12 shows this laminate.

As obvious from FIG. 12, a plurality of conductors 55 to 57 are stacked in the laminate 58 through magnetic layers as shown in the figure. The plurality of conductors 55 to 57 finally structure center electrodes respectively.

Figure 13:
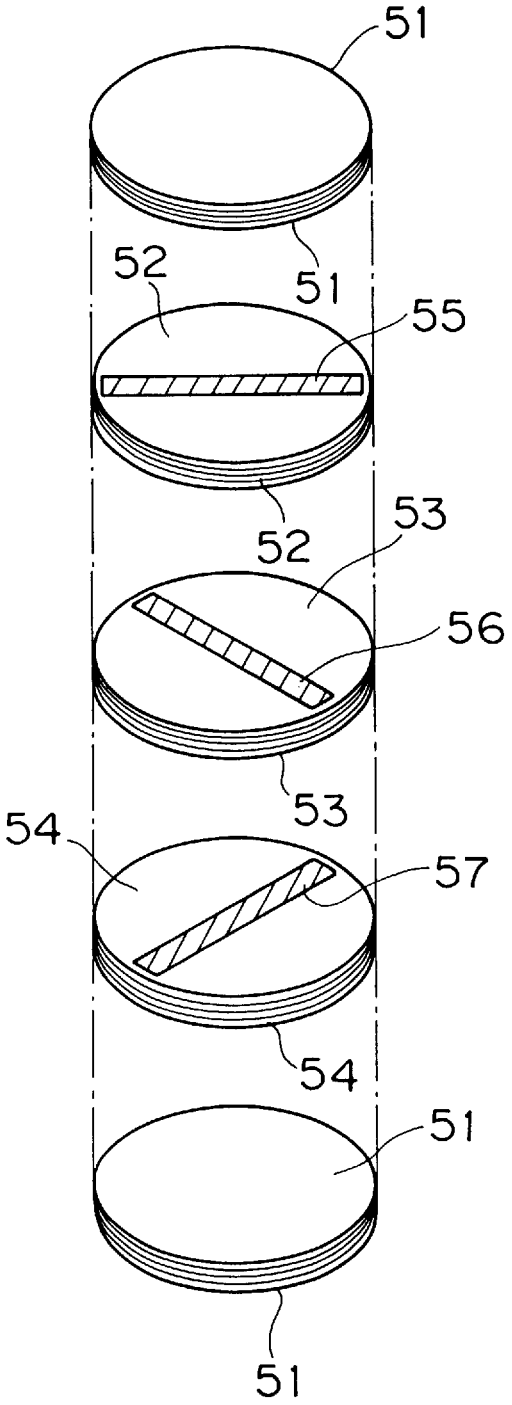
FIG. 13 is an exploded perspective view of a laminate chip punched in the form of a disc.

Then, the aforementioned laminate 58 was punched into the form of a disc having a diameter of about 10 mm about a portion where the conductors 55 to 57 intersected with each other, to obtain a discoidal unfired laminate chip. FIG. 13 shows an exploded perspective view of the discoidal laminate chip obtained in this manner. As obvious from FIG. 13, the conductors 55 to 57 are stacked in a state electrically insulated from each other through the magnetic layers respectively in the aforementioned discoidal laminate chip. In FIG. 13, reference numerals for the initially prepared magnetic green sheets are applied to the magnetic layers which were punched into the form of discs respectively.

Figure 14:
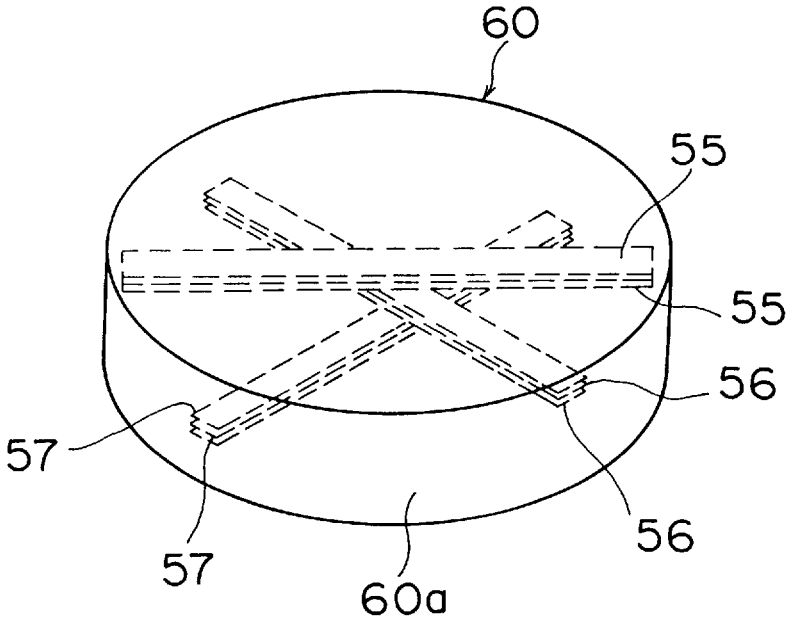
FIG. 14 is a perspective view for illustrating the microwave non-reciprocal circuit element obtained by the third embodiment.

Then, the discoidal laminate chip prepared in the aforementioned manner was fired by maintaining the same at a temperature of 1300° C. to 1500° C. for 5 to 15 hours, to obtain a sintered body. FIG. 14 shows the obtained sintered body in a perspective view. In the sintered body 60, a plurality of conductors 55 to 57 are stacked in the interior in plural through sintered body layers respectively. An outer peripheral side surface 60*a* of the sintered body 60 obtained in the aforementioned manner was polished to reliably expose both ends of the conductors 55 to 57 on the side surface, and forming external electrodes electrically connected to the respective conductors were formed. Formation of the external electrodes was carried out by applying conductive paste containing a glass frit and baking the same. A microwave non-reciprocal circuit element according to the third embodiment was obtained in the aforementioned manner.

In the microwave non-reciprocal circuit element according to this embodiment, one center electrode is formed by the aforementioned plurality of conductors 55, while one center electrode is similarly formed by the plurality of conductors 56 and one center electrode is formed by the plurality of conductors 57 similarly.

Then, earth electrodes were formed on upper and lower surfaces of the sintered body 60 of the non-reciprocal circuit element obtained in the aforementioned manner, or earth electrodes consisting of metal plates were brought into contact with the same, and respective single ends of the aforementioned three center electrodes were electrically connected and grounded. Further, permanent magnets were brought into contact with upper and lower portions of the sintered body, and a dc magnetic field was applied to the center electrodes by the permanent magnets. Further, the aforementioned permanent magnets were held by metal yokes to form a magnetic closed magnetic circuit, for structuring a non-reciprocal circuit device. An impedance matching capacitor which is connected to this type of non-reciprocal circuit device may be provided in the aforementioned sintered body, or in the exterior of the sintered body.

In the microwave non-reciprocal circuit element according to this embodiment, the center electrodes are formed by the plurality of conductors 55 to 57 respectively as described above, whereby conductor losses can be reduced also when miniaturization of the microwave non-reciprocal circuit element progresses similarly to the first embodiment. Therefore, it is possible to obtain a microwave non-reciprocal circuit element which is of low losses and miniature. In addition, stacking can be made by ceramic stacking-integral firing techniques as described above, whereby the number of components can be reduced as compared with a conventional method of manufacturing a microwave nonreciprocal circuit element employing metal foil. Further, it is also possible to omit a complicated manual operation. In addition, the conductors are formed by a printing step, whereby thinner conductors can be readily structured. Thus, it is possible to readily obtain a further miniaturized microwave non-reciprocal circuit element.

While magnetic sheets molded by a doctor blade coater were employed in the third embodiment, dielectric sheets may be employed in place of the magnetic sheets.

While the conductors were formed on the green sheets by screen printing in the aforementioned manufacturing method, another printing method such as gravure printing may be employed.

Further, preparation of the magnetic or dielectric sheets is not restricted to the doctor blade coater, but may alternatively be carried out by another method such as extrusion molding.

Further, previously molded green sheets may not be employed but the aforementioned laminate may be formed by repeating steps of printing paste containing a dielectric substance or a magnetic substance on support films of polyester or the like, drying the same and thereafter printing conductive paste.

While the plurality of conductors forming one center electrode were stacked in the direction of thickness and the plurality of conductors forming another center electrode were then stacked in the direction of thickness in the third embodiment, further, conductors forming different center electrodes may be stacked at random in the direction of thickness also in the third embodiment, similarly to the modification of the first embodiment.

Further, the plane shapes of the conductors 55 to 57 forming the center electrodes can also be modified in various manners, similarly to the modifications of the first embodiment.

Fourth Embodiment

Figure 15:
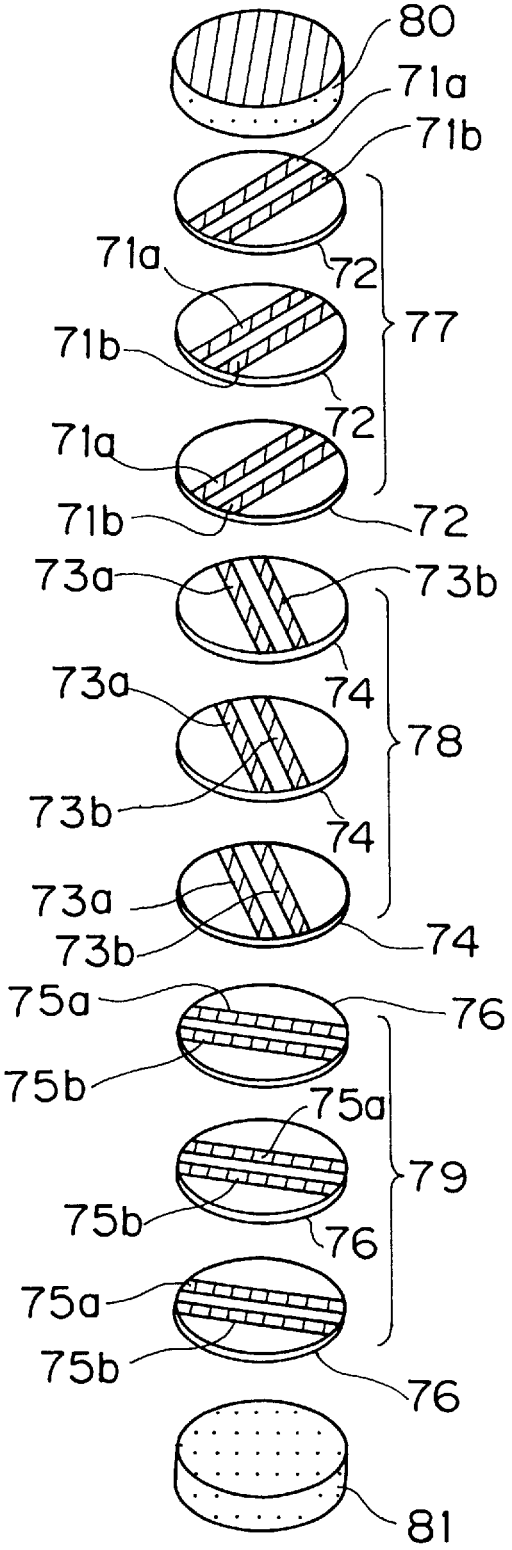
FIG. 15 is an exploded perspective view for illustrating a microwave non-reciprocal circuit element according to a fourth embodiment of the present invention.

While the plurality of conductors for structuring the respective center electrodes have been stacked in the directions of thickness through magnetic or dielectric layers in the aforementioned first to third embodiments, a plurality of conductors may be formed on the same height positions so that the plurality of conductors which are formed on the same height positions are further stacked in the direction of thickness through dielectric or magnetic layers in the microwave non-reciprocal circuit element. FIG. 15 shows such an example in an exploded perspective view.

In a microwave non-reciprocal circuit element according to a fourth embodiment, a pair of conductors 71*a* and 71*b* are formed in parallel with each other on a sheet 72 consisting of a dielectric material or an insulator material, as obvious from FIG. 15. A first center electrode portion 77 consisting of a plurality of conductors 71*a* and 71*b* is formed by stacking three such sheets 72. Similarly, a second center electrode portion 78 is formed by stacking a plurality of sheets 74 consisting of a dielectric material or an insulator material provided with pairs of conductors 73*a* and 73*b*. Further, a third electrode portion 79 is formed by stacking a plurality of sheets 76 consisting of a dielectric material or an insulator material provided with pairs of conductors 75*a* and 75*b*. The aforementioned first to third center electrode portions 77 to 79 are made to intersect with each other, to form center electrodes so that mutual conductors form angles of 120 degrees in a stacked state. 80 and 81 denote ferrites.

Figure 16:
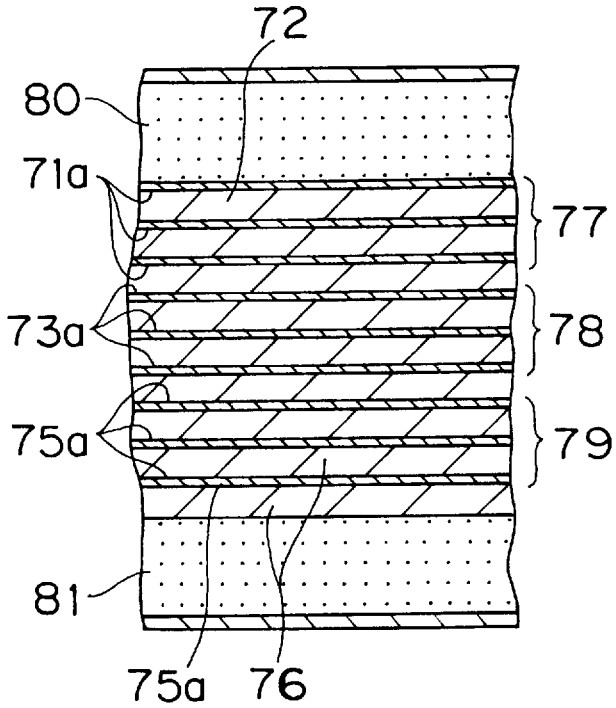
FIG. 16 is a partially fragmented sectional view showing a portion where conductors overlap with each other in the microwave non-reciprocal circuit element shown in FIG. 15.

FIG. 16 is a partially fragmented sectional view of the microwave non-reciprocal circuit element according to the fourth embodiment. This sectional portion illustratively shows only a portion where the aforementioned conductors 71*a*, 73*a* and 75*a* overlap with each other in the direction of thickness.

Figure 17:
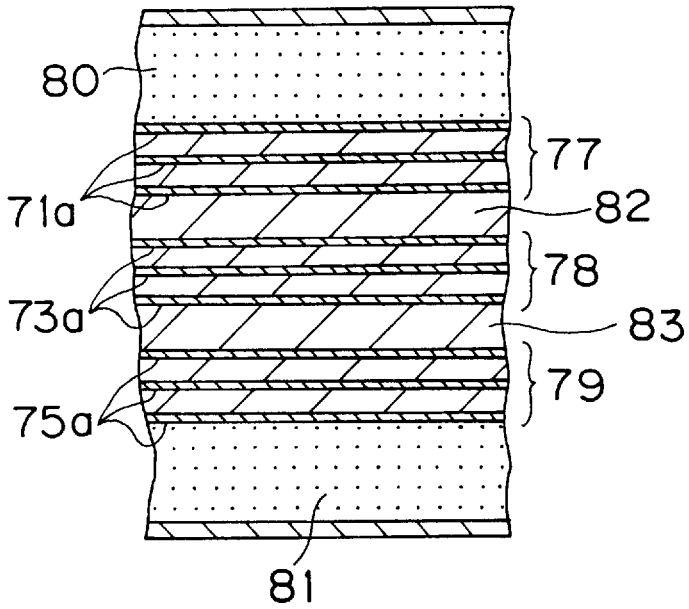
FIG. 17 is a partially fragmented sectional view for illustrating a modification of the microwave non-reciprocal circuit element according to the fourth embodiment, which is a diagram corresponding to FIG. 16.

Preferably, insulating layers 82 and 83 may be interposed between the first and third center electrode portions 77 to 79 in the microwave non-reciprocal circuit element according to the fourth embodiment, as shown in FIG. 17.

Also in the microwave non-reciprocal circuit element according to the fourth embodiment shown in FIGS. 15 and 16 and the microwave non-reciprocal circuit element according to the modification shown in FIG. 17, one center electrode is formed by a plurality of conductors overlapping with each other in the direction of thickness similarly to the cases of the first to third embodiments, whereby conductor losses in the center electrodes can be reduced similarly to the cases of the first to third embodiments. Further, the Q values of the center electrodes can be improved since electrical resistances of the respective center electrodes can be reduced.

Fifth Embodiment

While conductor losses can be reduced since the center electrodes are formed by the plurality of conductors which are stacked in the direction of thickness as hereinabove described in the aforementioned first to fourth embodiments, it is possible to further improve electric characteristics of a non-reciprocal element more preferably, by devising arrangement of conductors structuring first to third center electrode portions, as in a fifth embodiment described in the following.

Figure 18:
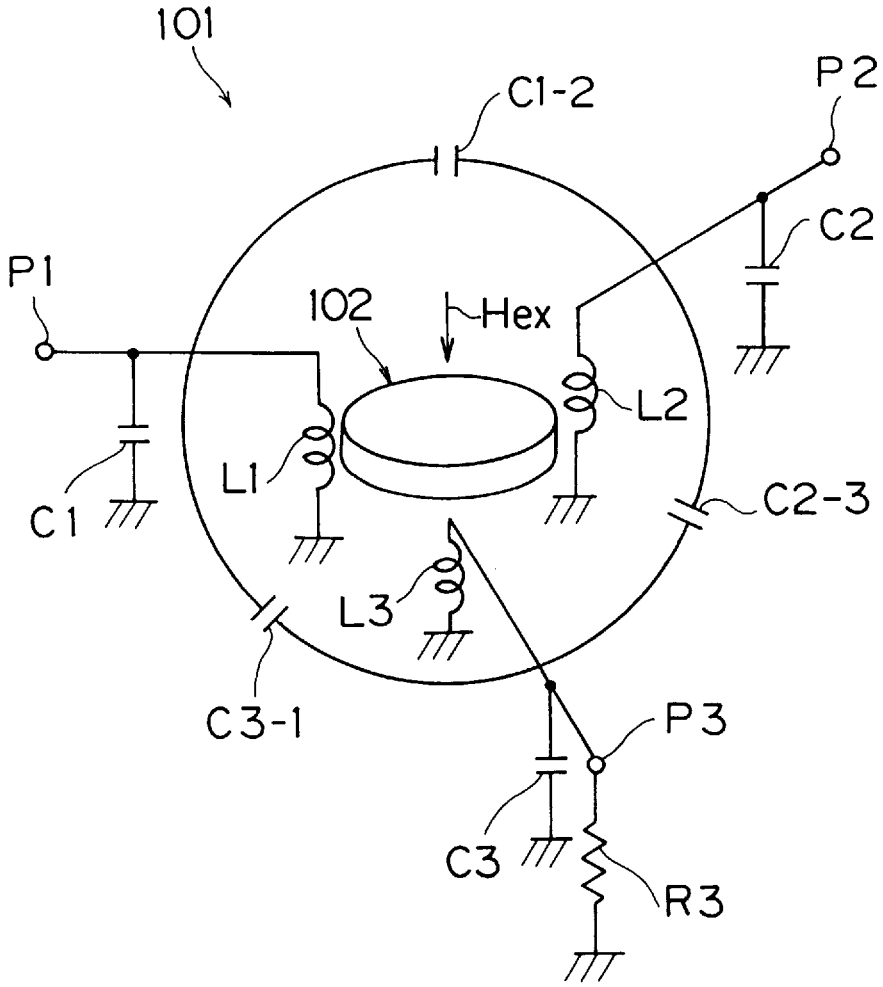
FIG. 18 is a diagram for illustrating an equivalent circuit of a general isolator.

FIG. 18 shows a basic equivalent circuit of a general lumped element type isolator. This isolator 101 is formed by arranging three central conductors L1 to L3 on a ferrite 102 in an electrically insulated state to intersect at angles of 120 degrees, and applying a dc magnetic field Hex in the axial direction of the ferrite 102. First ends of the aforementioned respective central conductors L1 to L3 are connected to the ground, while matching capacitive elements C1 to C3 are connected to second ends. Further, a terminal resistor R3 is connected to a terminal P3 of one center electrode L3 among the aforementioned respective central conductors L1 to L3. The aforementioned isolator 101 has a function of transmitting a signal from a terminal P1 to a terminal P2, and absorbing a wave approaching from the terminal P2 by the terminal resistor R3 for inhibiting transmission to the terminal P1, thereby preventing an unnecessary wave from entering a power amplifier or the like.

Referring to the non-reciprocal circuit element according to the fourth embodiment indicated by the equivalent circuit of FIG. 18, for example, there is such a problem that distributed capacitances across the first to third center electrode portions are not equal to each other. Namely, the first center electrode portion 77 and the third center electrode portion 79 are structured on upper and lower portions of the second center electrode portion 78 in the structures shown in FIG. 15 and FIG. 16. Therefore, a distributed capacitance across the second center electrode portion 78 and the first center electrode portion 77 and a distributed capacitance across the second center electrode portion 78 and the third center electrode portion 79 are equal to each other. However, there is such a problem that a distributed capacitance across the first and third center electrode portions 77 and 79 is reduced, dissimilarly to the distributed capacitances across the aforementioned second center electrode portion 78 and the outer center electrode portions 77 and 79. In other words, a distributed capacitance C3-1 across the terminal P1 and the terminal P3 shown in FIG. 18 is reduced as compared with distributed capacitances C1-2 and C2-3.

In order to compensate for the shortage of the aforementioned distributed capacitance C3, it is conceivable to increase matched capacitances of the matching capacitive elements C1 and C3 which are connected to the terminals P1 and P3. When the capacitances of the matching capacitive elements C1 and C3 are increased, however, the operation balance is so deteriorated that dispersion is caused in insertion loss characteristics and isolation characteristics across the respective terminals P1 to P3, return loss characteristics and uniform electric characteristics cannot be obtained.

A lumped element type isolator according to the fifth embodiment solves the aforementioned problems, and hence the same shows further preferable mode of the present invention.

Referring to FIGS. 19 to 21, 105 is an isolator characterizing this embodiment, and this is structured by arranging first to third center electrode portions 106 to 108 described later so that the same intersect with each other at intervals of 120 degrees, arranging ferrites 109 and 110 on upper and lower portions thereof, and integrally forming the ferrites 109 and 110 and the aforementioned respective center electrode portions 106 to 108.

Earth plates 111*a* and 111*b* are arranged on outer surfaces of the aforementioned respective ferrites 109 and 110, and these earth plates 111*a* and 111*b* are connected to outer peripheral surfaces of the aforementioned isolator 105 through earth electrodes 112*a* to 112*c* which are formed at intervals of 120 degrees along the circumferential direction thereof.

Further, input/output terminal electrodes 113*a* to 113*c* are formed between the respective earth electrodes 112*a* to 112*c* on the outer peripheral surfaces of the aforementioned isolator 105, and a terminal resistor which is not shown is connected to one terminal electrode 113*c* among the same. When the aforementioned input/output terminal electrode 113*c* is connected to an external circuit without connecting this terminal resistor, this embodiment functions as a circulator.

First end portions of the aforementioned first to third center electrode portions 106 to 108 are connected to the aforementioned earth electrodes 112*a* to 112*c* respectively, while second end portions are connected to the aforementioned input/output terminal electrodes 113*a* to 113*c* respectively.

The aforementioned isolator 105 is stored in a magnetic yoke forming a magnetic closed circuit which is not shown, and is structured by applying a bias dc magnetic field to axial cores of the aforementioned ferrites 109 and 110 by permanent magnets which are arranged in the yoke.

The aforementioned first to third center electrode portions 106 to 108 are formed by pattern-forming triple conductors 114*a* to 114*c*, 115*a* to 115*c* and 116*a* to 116*c* on insulating sheets 117 respectively, and alternately stacking the same while opposing the same to each other, and are in such a structure that the second center electrode portion 107 is held by the first and third center electrode portions 106 and 108.

Figure 19:
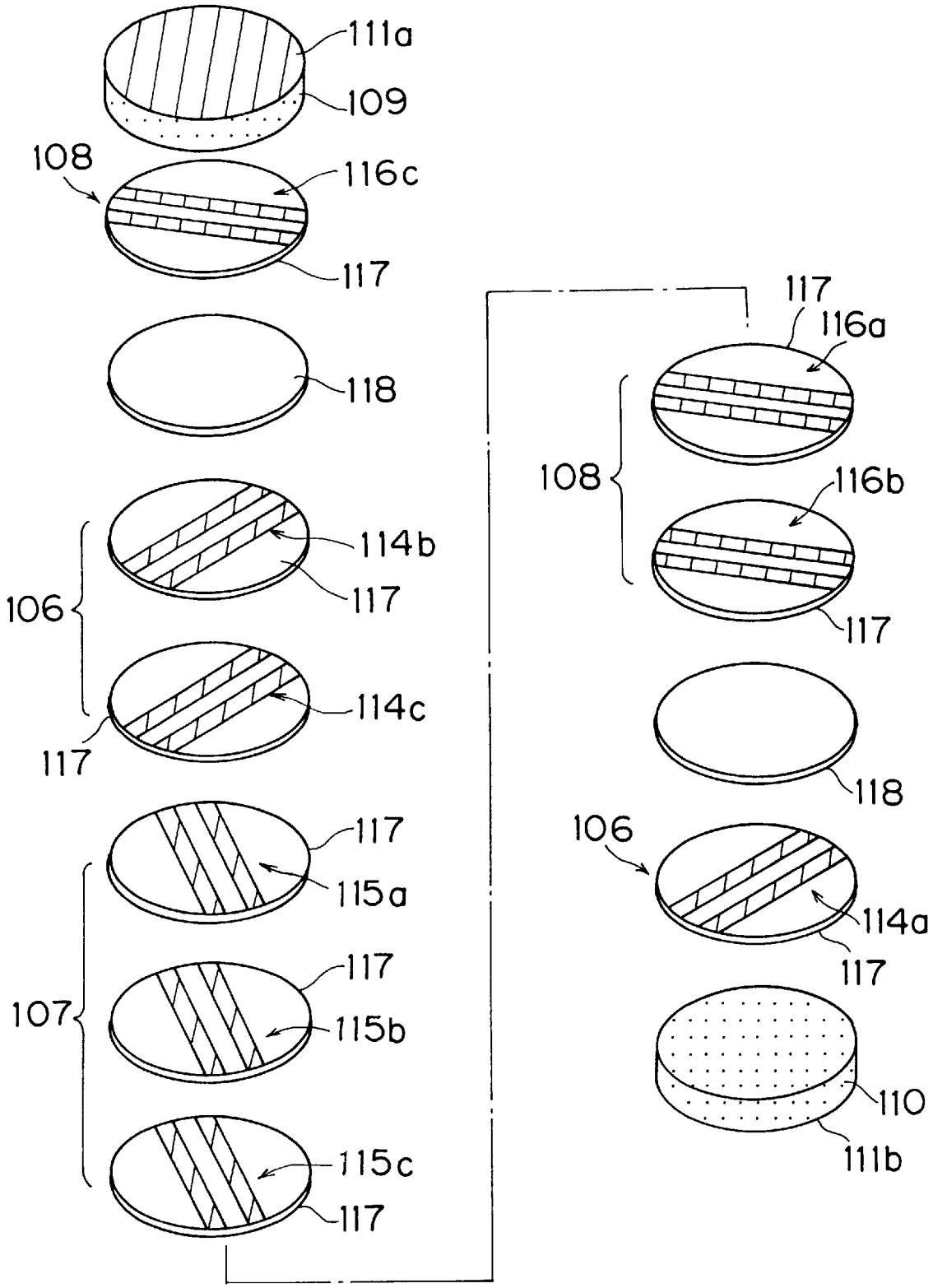
FIG. 19 is an exploded perspective view for illustrating an electrode arrangement structure of a microwave non-reciprocal circuit element according to a fifth embodiment of the present invention.
Figure 20:
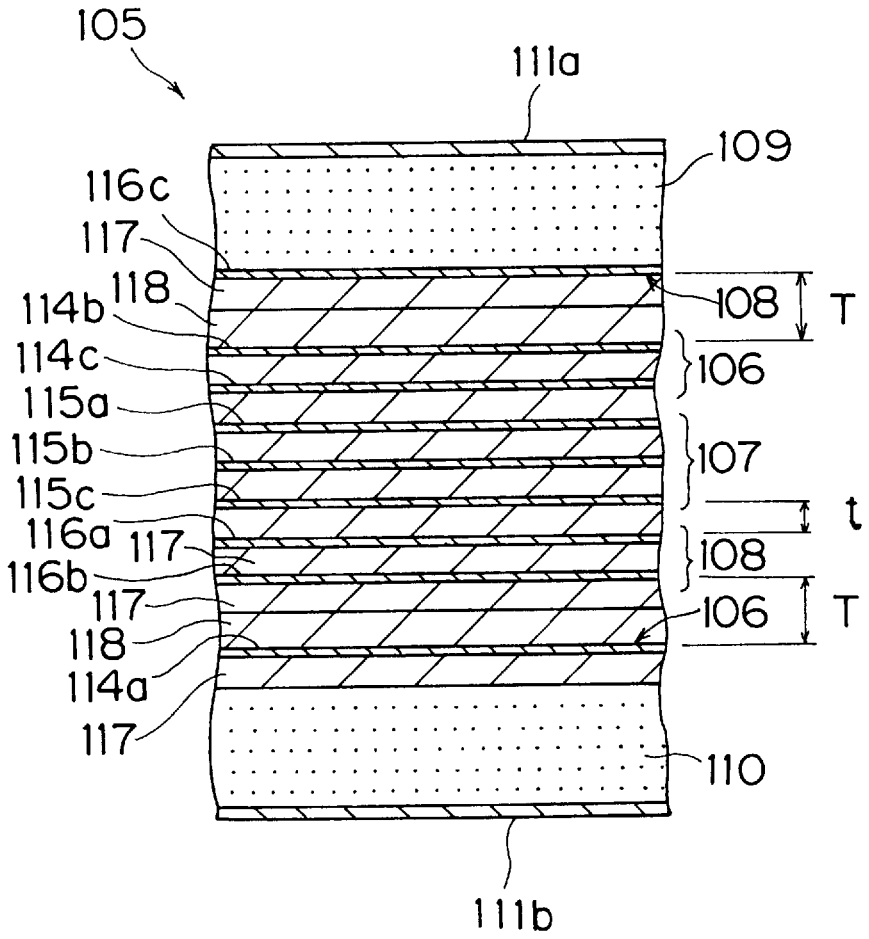
FIG. 20 is a partially fragmented sectional view for illustrating an isolator according to the fifth embodiment of the present invention.

As shown in FIGS. 19 and 20, the conductor 114*a* which is positioned on an outer side of the aforementioned first center electrode portion 106 is arranged adjacently to an outer side of a lower portion of the third center electrode portion 108, while the conductor 116*c* which is positioned on an outer side of the third center electrode portion 108 is arranged adjacently to the outer side, i.e. an upper portion of the aforementioned first center electrode portion 108. The conductor 114*a* of the aforementioned first center electrode portion 106 is connected to the aforementioned terminal electrode 113*a* and the earth electrode 112*a* with the aforementioned conductors 114*b* and 114*c*, while the conductor 116*c* of the aforementioned third center electrode portion 108 is connected to the aforementioned terminal electrode 113*c* and the earth electrode 112*c* with the conductors 116*a* and 116*b*.

Further, an insulating sheet 118 is interposed between the aforementioned conductor 114*a* and the third center electrode portion 108, while an insulating sheet 118 is interposed between the aforementioned conductor 116*c* and the first center electrode portion 106. Thus, distances T between the aforementioned respective conductors 114*a* and 116*c* and the center electrode portions 108 and 106 are substantially twice a distance t between the conductors of the central portions respectively.

Description is now made on action/effect of this embodiment.

According to this embodiment, the conductors 114*a* and 116*c* which are positioned on the outer sides of the first and third center electrode portions 106 and 108 are replaced and arranged to be adjacent to outer sides of the opposite side center electrode portions 108 and 106 respectively while the distance T therebetween is widened to about twice the distance t between the conductors of the central portion, whereby sufficient distributed capacitances can be attained by these conductors 114*a* and 116*c* and the third and first center electrode portions 108 and 106 which are adjacent thereto, and hence values equivalent to the distributed capacitances across the second center electrode portion 107 and the first and third center electrode portions 106 and 108 adjacent thereto. Consequently, the balance of operations between the respective center electrode portions 106 to 108 can be improved, insertion loss characteristics, isolation characteristics and return loss characteristics can be uniformalized, and it is possible to cope with improvement in performance.

According to this embodiment, matched capacitances of center electrodes can be taken by the distributed capacitances across the aforementioned respective center electrode portions 106 to 108 while distributed capacitances can be taken across the respective conductors 114*a* and 116*c* and the earth plates 111*a* and 111*b* of the ferrites 109 and 110, whereby it is possible to attain matched capacitances in the aforementioned ferrites 109 and 110. Consequently, a conventional matching circuit element which has been separately added can be made unnecessary, it is possible to cope with miniaturization and weight reduction due to capability of reducing the number of components, while it is possible to contribute to cost reduction. Alternatively, this embodiment may be combined with a matching circuit element.

According to this embodiment, further, the conductors 114*a* to 114*c*, 115*a* to 115*c* and 116*a* to 116*c* of the respective center electrode portions 106 to 108 are stacked into multilayer structures, whereby Q values of the center electrode portion can be improved, and insertion losses can be thereby reduced. Further, it is also possible to employ a technique of cofiring the aforementioned respective center electrodes, the matched capacitances etc. in the ferrites, and the aforementioned respective electric characteristics can be further improved in this case.

Figure 21:
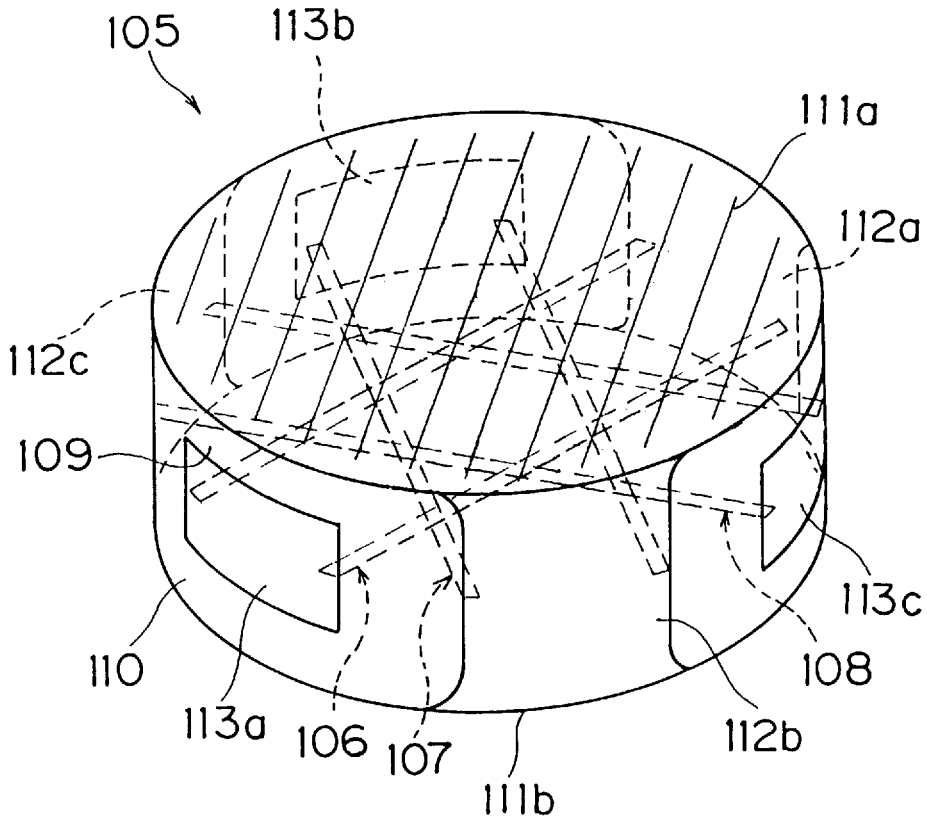
FIG. 21 is a perspective view for illustrating the isolator according to the fifth embodiment of the present invention.

As obvious from FIG. 21, further, it is preferable to make the triple conductors of different height positions forming the center electrode portions not to overlap with each other in the direction of thickness, for stabilization of the characteristics.

While each center electrode portion has been formed by three layer center electrodes in the aforementioned embodiment, the present invention is not restricted to this but the same may be formed by two or at least four layer center electrodes.

Figure 22:
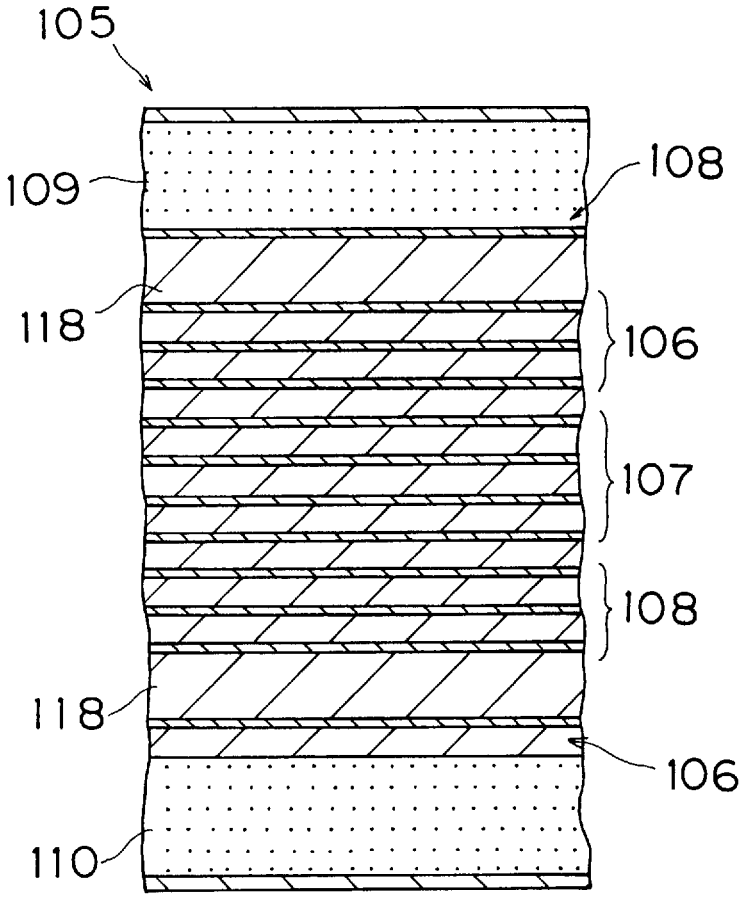
FIG. 22 is a partially fragmented sectional view for illustrating a modification of the isolator according to the fifth embodiment of the present invention.

FIG. 22 shows a modification of the aforementioned embodiment, and in this figure, reference numerals identical to those in FIG. 19 denote the same or corresponding portions. This modification is such an example that each of center electrode portions 106 to 108 is formed by four layer center electrodes, and an effect similar to that of the aforementioned embodiment is attained also in this case by replacing and arranging center electrodes on outer sides of the firs and third center electrode portions 106 and 108 respectively.

While each of the aforementioned embodiments has been applied to a case of bringing an isolator into a discoidal shape, a shape of a rectangular parallelopiped or a polygon is also available with no particular restriction. Further, while the aforementioned embodiments have been described with reference to isolators, the present invention is also applicable to a circulator as a matter of course, and is also applicable to other microwave high-frequency components.

We claim:

1. A microwave non-reciprocal circuit element comprising:

a plurality of center electrodes being arranged to intersect with each other in a state being electrically insulated from each other and one end of each being connected to a ground potential; and one material selected from the group consisting of a microwave magnetic and a dielectric body on which a plurality of center electrodes are arranged, each center electrode being formed by a plurality of conductors being stacked in parallel with and overlapping each other through one of the microwave magnetic and dielectric body wherein the plurality of conductors forming said each center electrode are embedded in the microwave magnetic or dielectric body, the respective center electrodes being successively arranged in the direction of thickness in said microwave magnetic or dielectric body.

2. The microwave non-reciprocal circuit element in accordance with claim 1, wherein a pair of said conductors are formed on the same height position.

3. A microwave non-reciprocal circuit element comprising:

a plurality of center electrodes being arranged to intersect with each other in a state being electrically insulated from each other and one end of each being connected to a ground potential: and one material selected from the group consisting of a microwave magnetic and a dielectric body on which a plurality of center electrodes are arranged, each center electrode being formed by a plurality of conductors being stacked in parallel with each other through one of the microwave magnetic and dielectric body having first to third center electrode portions consisting of said plurality of conductors and being successively arranged in the direction of thickness, at least one conductor forming said first center electrode portion is arranged on an outer side of the third center electrode portion in the direction of thickness, and at least one conductor forming the third center electrode portion is arranged on an outer side of the first center electrode portion in the direction of thickness, and the distances between at least one conductor arranged on the outer side of said third center electrode portion and at least one conductor arranged on the outer side of the first center electrode portion, and the conductor of the third or first center electrode portion being adjacent in the direction of thickness is made larger than the distance between other adjacent conductors.

4. The microwave non-reciprocal circuit element in accordance with claim 3, wherein the distance between at least one conductor arranged on the outer side of said third center electrode portion and at least one conductor arranged on the outer side of the first center electrode portion, and the conductor of the third or first center electrode portion being adjacent in the direction of thickness is made about twice the distance between other adjacent conductors.

5. The microwave non-reciprocal circuit element in accordance with claim 4, wherein said first to third center electrode portions are so arranged that the conductors thereof intersect with each other at angles of 120 degrees.

6. The microwave non-reciprocal circuit element in accordance with claim 4, wherein a pair of said conductors are formed on the same height position.

7. The microwave non-reciprocal circuit element in accordance with claim 3, wherein said first to third center electrode portions are so arranged that the conductors thereof intersect with each other at angles of 120 degrees.

8. The microwave non-reciprocal circuit element in accordance with claim 3, wherein a pair of said conductors are formed on the same height position.

* * * * *

UNITED STATES PATENT AND TRADEMARK OFFICE

CERTIFICATE OF CORRECTION

PATENT NO. : 5,774,024

DATED : June 30, 1998

INVENTOR(S) : Hiroshi MARSUAWA et al.

It is certified that error appears in the above-identified patent and that said Letters Patent is hereby corrected as shown below:

In Section [22], delete "Sep. 25, 1996" and insert -- Nov. 25, 1995 --.

Signed and Sealed this

Twenty-sixth Day of January, 1999

*Attest:*

*Attesting Officer*

*Acting Commissioner of Patents and Trademarks*

UNITED STATES PATENT AND TRADEMARK OFFICE

CERTIFICATE OF CORRECTION

PATENT NO. : 5,774,024

DATED : June 30, 1998

INVENTOR(S) : Hiroshi MARSUAWA et al.

It is certified that error appears in the above-identified patent and that said Letters Patent is hereby corrected as shown below:

On the title page,

In Section [22], delete "Sep. 25, 1996" and insert --Nov. 25, 1996--.

This certificate supersedes Certificate of Correction issued January 26, 1999.

Signed and Sealed this

Third Day of August, 1999

*Attest:*

Q. TODD DICKINSON

*Attesting Officer*

*Acting Commissioner of Patents and Trademarks*